US012410699B2

(12) United States Patent
Stewart et al.

(10) Patent No.: US 12,410,699 B2
(45) Date of Patent: Sep. 9, 2025

(54) APPARATUS AND METHOD FOR MEASURING DRILLING PARAMETERS OF A DOWN-THE-HOLE DRILLING OPERATION FOR MINERAL EXPLORATION

(71) Applicant: Globaltech Corporation Pty, Canning Vale (AU)

(72) Inventors: Gordon Stewart, Claremont (AU); Raymond Hill, Kingsley (AU)

(73) Assignee: Globaltech Corporation Pty, Canning Vale (AU)

( * ) Notice: Subject to any disclaimer, the term of this patent is extended or adjusted under 35 U.S.C. 154(b) by 0 days.

(21) Appl. No.: 15/523,940

(22) PCT Filed: Nov. 12, 2015

(86) PCT No.: PCT/AU2015/050705
§ 371 (c)(1),
(2) Date: May 3, 2017

(87) PCT Pub. No.: WO2016/074038
PCT Pub. Date: May 19, 2016

(65) Prior Publication Data

US 2017/0321534 A1 Nov. 9, 2017

(30) Foreign Application Priority Data

Nov. 12, 2014 (AU) ..... 2014904547

(51) Int. Cl.
*E21B 47/00* (2012.01)
*E21B 44/00* (2006.01)
(Continued)

(52) U.S. Cl.
CPC ..... *E21B 47/007* (2020.05); *E21B 44/00* (2013.01); *E21B 45/00* (2013.01); *E21B 47/00* (2013.01);
(Continued)

(58) Field of Classification Search
None
See application file for complete search history.

(56) References Cited

U.S. PATENT DOCUMENTS 7,497,276 B2 * 3/2009 Pastusek ..... E21B 47/017 73/152.45
2009/0216455 A1 * 8/2009 Reckmann ..... E21B 47/12 702/9

(Continued)

FOREIGN PATENT DOCUMENTS

| | | |
|---|---|---|
| EP | 0553908 B1 | 10/1996 |
| WO | 2013134814 A1 | 9/2013 |
| WO | 2014105034 A1 | 7/2014 |

OTHER PUBLICATIONS

Written Opinion from AU Patent Office for PCT/2015/050705, Dec. 23, 2015.

*Primary Examiner* — Jill E Culler
(74) *Attorney, Agent, or Firm* — Knobbe, Martens, Olson & Bear, LLP

(57) ABSTRACT

Apparatus (100) for measuring drilling parameters of a down-the-hole drilling operation for mineral exploration includes a module 10.1 mounted in-line with a drill string (110) and proximate to a drill bit (120). The drill string (110) is rotated and progressed down the hole. The module (10) has sensors for sensing conditions. The apparatus (100) measures drilling parameters based on the sensed conditions. The measured data is logged in the module (10) and then transmitted to a computer for a drilling operator's use. The drilling operator monitors progress and optimises performance of the drilling operation based on the measured data. Measurement of drilling parameters based on sensed data proximate to the drill bit enables accurate determination of actual WOB, torque and RPM fluctuations, axial vibration, radial vibration, temperature, RPM. A second module
(Continued)

10.2 is mounted in-line with the same drill string (110) but away from the drill bit (120). The second module 10.2 measures the same drilling parameters as the module 10.1 proximate to the drill bit (120). The driller is provided with the data recorded by the second module 10.2 to judge the performance of the drilling operation. Comparing drilling parameters based on sensed data proximate to the drill bit and distal to the drill bit enables accurate determination of vertical drag/resistance of the drill string (110) within the hole, rotational resistance of the drill string (110), degree of wind-up of the drill string (110) and presence of stick-slip conditions at lower end of the drill string (110).

22 Claims, 15 Drawing Sheets

(51) Int. Cl.

| | |
|---|---|
| ***E21B 45/00*** | (2006.01) |
| ***E21B 47/007*** | (2012.01) |
| ***E21B 47/017*** | (2012.01) |
| ***E21B 47/07*** | (2012.01) |
| ***E21B 47/12*** | (2012.01) |

(52) U.S. Cl.
CPC ..... *E21B 47/017* (2020.05); *E21B 47/07* (2020.05); *E21B 47/12* (2013.01)

(56) References Cited

U.S. PATENT DOCUMENTS

| | | | | |
|---|---|---|---|---|
| 2009/0255731 | A1* | 10/2009 | Backhaus | E21B 47/12 175/50 |
| 2010/0025110 | A1* | 2/2010 | John | E21B 44/00 175/27 |
| 2010/0089645 | A1* | 4/2010 | Trinh | E21B 10/00 175/50 |
| 2010/0300755 | A1* | 12/2010 | Trinh | E21B 45/00 175/40 |
| 2012/0109382 | A1* | 5/2012 | Dashevskiy | E21B 44/00 700/275 |
| 2012/0111633 | A1* | 5/2012 | Kumar | E21B 47/0006 175/50 |
| 2012/0152542 | A1* | 6/2012 | Le | E21B 43/11 166/297 |
| 2013/0032412 | A1 | 2/2013 | Haugvaldstad | |
| 2013/0049981 | A1* | 2/2013 | MacPherson | E21B 44/00 340/853.1 |
| 2013/0147633 | A1* | 6/2013 | Sumrall | E21B 47/124 340/854.4 |
| 2013/0186195 | A1* | 7/2013 | Schlosser | E21B 47/0006 73/152.59 |
| 2013/0215715 | A1* | 8/2013 | Hollstein | G01V 11/00 367/35 |
| 2014/0190747 | A1 | 7/2014 | Halliburton | |
| 2016/0040524 | A1* | 2/2016 | Ravi | E21B 33/13 166/253.1 |

* cited by examiner

APPARATUS AND METHOD FOR MEASURING DRILLING PARAMETERS OF A DOWN-THE-HOLE DRILLING OPERATION FOR MINERAL EXPLORATION

FIELD OF THE INVENTION

The present invention relates to an apparatus and a method for measuring drilling parameters of a down-the-hole drilling operation for mineral exploration.

BACKGROUND TO THE INVENTION

Mineral exploration is the process of finding commercially viable concentrations of minerals to mine. Drilling is often conducted as a part of an advanced exploration program to obtain detailed information about the rocks below the ground surface. The drilling method and size of the drilling rig used depends on the type of rock and information sought.

A number of drilling techniques are used in the mineral exploration industry. Some of these are air-core drilling, reverse-circulation (RC) drilling, diamond core drilling, and rotary mud drilling.

Air-core drilling employs hardened steel or tungsten blades to bore a hole into unconsolidated ground. The drill bit generally has three blades. Drill rods are hollow and are fitted with an inner tube within the outer barrel, similar to the rods used for reverse circulation drilling (described below).

Drill cuttings are recovered by injection of compressed air into the annulus between the inner tube and the inside wall of the drill rod, and are lifted to the surface by upward air flow through the inner tube. Samples are then passed through a sample hose into a cyclone where they are collected in buckets or bags.

Reverse Circulation (RC) drilling is similar to air core drilling, in that the drill cuttings are returned to surface inside the rods.

The drilling mechanism is a pneumatic reciprocating piston known as a hammer driving a tungsten-steel drill bit. RC drilling generally produces dry rock chips, depending on the operating conditions, as the expanding air exhausted from the hammer displaces and lifts any water present to the surface via the annulus between the drill string and the hole, whilst the cuttings are directed up the relatively water free inner pipe to the sampling system at the surface.

Reasonably large air compressors are used to power the pneumatic hammer, with higher volumes of air and greater pressures being required as borehole depth increases.

Diamond core drilling differs from other drilling methods used in mineral exploration in that a solid core of rock (generally 27 to 85 mm in diameter, but can be up to 200 mm), rather than cuttings, is extracted from depth. This method uses a rapidly rotating drill bit that relies on water and drilling fluids, pumped from an in-ground sump or above ground tanks, to cool and lubricate the drill bit during operation.

As the drill rods advance, the cylinder of remaining rock gradually becomes enveloped by the drill rods. Ground up rock material is transported to the surface by the returning drilling fluids and is separated from the fluids, typically in drill sumps or small ponds. Sometimes the separation is achieved mechanically using a series of screens, cyclones and filter pads, rather than simply relying on gravity as it the case with the aforementioned.

Rotary mud drilling method generally is used for drilling through soft to medium hardness formations especially in the search for coal and other hydrocarbons. The rotary bit is normally comprised of 3 roller cones (tri-cones) arranged such that they rotate about their own axis of symmetry as well as the drill string axis upon rotation of the latter. This combined with a high drill string down force produces a crushing/grinding/dragging action at the bottom of the hole to thereby produce rock cuttings. A special mix of clay and water is forced down the drill hole whilst rotating the drill string, the purpose of which is to flush the cuttings from the bottom of the hole and convey them to the surface via the annular cavity between the drill string and the hole.

Drilling equipment generally comprises a drill bit attached to a drill string, a drive system and a mast to support the drill string. There may be a pneumatic hammer to reciprocate the drill bit in order to strike the rock with force. The drill string is rotated by the drive system, such as a top drive system, and pushed downwards (or pulled inwards). The drill bit is driven down the hole. Drilling fluid, such as compressed air or mud, is pumped through the drill string and dispensed at the drill bit. As the drill bit breaks the rock, the drill cuttings are flushed out of the hole by the pressurised fluid.

Monitoring drilling parameters is an important aspect of drilling operation. The performance and progress of the drilling operation are controllable by monitoring the parameters.

Currently, drilling parameters of a drilling operation for mineral exploration are measured at the surface. This measurement technique involves several estimations and assumptions and is therefore inaccurate.

Such drilling can be at times 1 to 2 km deep in ground and therefore the operator and any monitoring equipment used normally is quite remote from the bit. As a result the drilling parameters measured at the surface can be very different to those actually on the drill bit.

Two important drilling parameters that need to be measured are weight on bit (WOB), and torque on bit.

WOB is the amount of downward force exerted on the drill bit. Drillers need to know WOB to control the amount of downward force required to break the rock.

Torque on bit is the rotational force available at the bit. Torque measurement provides useful information to reduce inefficiencies in down-the-hole drilling operation. For example:

- If torque increases abnormally or higher than expected, for assumed conditions, the hole may be tightening because of expanding clays or accumulation of cuttings. These may bind portions of the drill string to the hole. Such binding needs to be rectified before it becomes difficult to reverse.
- Oftentimes, in case of bits having diamond cutters, drillers will deliberately reduce the supply of cooling fluid to the bit in order to strip the face of polished diamonds. This exposes a fresh layer of sharp diamonds for greater cutting action. If reducing of cooling fluid is overdone, excessive load or inadequate cooling could cause the bit to 'weld' to the bottom of the hole. Such 'welding' of the bit may be indicated by a fluctuating torque.

A largely inaccurate estimate of WOB measurement is obtained when measured at the surface because of the number of unaccounted and unknown factors.

WOB is ideally synonymous with the thrust force on the bit. At the drillers console the thrust force is estimated by reading the input pressure to the hydraulic cylinder. However, the actual WOB is a sum of:

thrust or hold-back force exerted on the drill string by the rig which is often referred to as 'hook-load', weight of the total drill string which may be more than 1 km long and weigh more than 100 kN, float or buoyancy provided by the mud which is dependent on the specific gravity of the mud, and axial friction between drill string and the hole, which is largely unknown.

Like WOB estimate, the torque on bit estimated at the surface is also grossly inaccurate because of several unaccounted and unknown factors. Rotation torque is estimated by reading the input pressure to the hydraulic motor. However, the actual torque transmitted to the bit face is influenced by at least the following factors:

torque applied to the top of the string, rotational speed of the string, variable clearances between the string and the hole, deviation of the hole from its intended course (the hole may be in excess of 1 km deep, so any small deviations could result in a multitude change in torque), inclination to the vertical could cause the string to lie along lower side of the hole, use of wedging to produce a deliberate deflection or bend in the hole, friction levels due to the presence of abrasive cuttings being conveyed inside and outside the drill string, lubricity of the mud, often additives such as oils and emulsions are used in mud to reduce frictional torque, and viscosity of the mud which may vary between 1 and 60+ cP and significantly influence torque of the bit.

Drilling operator (driller) monitors WOB and torque, measured at the surface, in view of the rate of penetration measured by a simple displacement sensor. They try to keep WOB and torque to 'normal' values for a particular penetration rate. The 'normal' values are obtained from the driller's personal experience.

Additionally, drillers also monitor coolant inflow, cuttings outflow, RPM (measured at the surface), and general vibration in the drill string. Therefore, drilling for mineral exploration is heavily reliant on experienced personnel. This not only increases costs but also exacerbates the difficulty of training new drillers to operate the drilling equipment.

These problems are enlarged because of gross inaccuracies in WOB and torque measured at the surface.

Also, accurate measurement of drilling parameters could provide some useful information to reduce inefficiencies in mineral drilling.

Therefore, it is advantageous to measure drilling parameters accurately.

Systems for measuring rock drilling parameters more accurately than by surface measurement techniques have been proposed in the oil and gas industry. However, these systems are not readily adaptable to mineral exploration because they are expensive, complicated, large, and are designed to be operated under different conditions.

For example, borehole size (diameter) for mineral exploration is much smaller than that of oil and gas exploration. Therefore, the bulky systems available for oil and gas exploration are not useable for down-the-hole drilling for mineral exploration.

Furthermore the complexity of equipment required for measurements in drilling for oil and gas and the associated costs are not justified in drilling for mineral exploration.

Typical differences between mineral exploration i.e. rock drilling and drilling for submerged oil/gas reservoirs are given in the table below.

| Parameter | Oil & Gas | Mineral Industry |
|---|---|---|
| Drilling COST/day, typ. | $250,000 | $20,000 |
| Drill Type | Rotary | Diamond Coring |
| Speed-RPM | 0~120 | 200~1500 |
| Formation | Soft-medium | Medium-Hard |
| Rig Power, (kW) | 800 | 100 |
| Depth (typical), (m) | 1500~3000 | 300~1500 |
| BHA[1] length (m) | 100~300 | 2~3 |
| Collar Wall thickness | 30-80 | 5 |
| Hole Diameter | 300~500 | 50~100 |
| String Diameter | 115~165 | 76~102 |
| MWD Telemetry | Mud pulse, 12~16 Bit | None |
| WOB (weight-on-bit) | 25 kN/inch dia | 15 kN/inch dia. |

Note 1. BHA = Bottom Hole Assembly = tools at bottom of the hole including collars, the latter being added for extra down force Generally the measurement systems used in the Oil and Gas industry are obtained from and operated by a specialist provider.

SUMMARY OF THE INVENTION

It is desirable of the present invention to provide an apparatus and method for measuring rock drilling parameters for mineral exploration which provides more accurate measurements than surface measurement techniques currently in use.

It is further desirable of the present invention to provide drilling parameter measurement apparatus which is readily useable with current drilling operations, cost effective, and adequately accurate, in relation to mineral exploration.

It is yet further desirable of the present invention to provide an apparatus to measure other drilling parameters, proximate to the bit, such as instantaneous rpm, axial and radial vibrations, and temperature.

It is still further desirable of the present invention to measure and compare drilling parameters proximate to the drill bit and distal to the drill bit.

It is further desirable of the present invention relating to drilling operation for mineral exploration to reduce uncertainties, report and compare performance, optimise performance, assist in developing drilling simulation, to make training of drillers easier.

With the aforementioned in mind, a first aspect of the present invention provides an apparatus for measuring drilling parameters of a down-the-hole drilling operation for mineral exploration, the apparatus including a module mountable within a drill string and proximate to a drill bit, the module having sensors for sensing conditions proximate to the drill bit, wherein the apparatus measures drilling parameters based on the sensed conditions.

Preferably, the module is mounted adjacent the drill bit.

By measuring drilling parameters based on conditions sensed proximate to the drill bit, accuracy of the measurements is greatly increased in comparison with surface measurement techniques.

Drilling parameters such as the actual WOB and the actual torque on bit can be measured directly proximate to the drill bit. The driller has a better understanding of the conditions at the bottom of the hole. Uncertainties in monitoring of drilling operations are reduced by eliminating the gross assumptions and estimations. Therefore, it is possible to optimise drilling performance by design/selection of the drilling tool, procedure, and strategy.

Furthermore, the data gathered at the bottom of the hole could be used to develop drilling simulations for training purposes.

Ideally, the data recorded by the module may be provided to the driller in real time. Alternatively, the data may be recorded and time stamped so that it can be downloaded and analysed once the module is returned to the surface.

The module may be sealed such that the module acts as a pressure vessel for components inside the module. The external conditions surrounding the module are harmful for the components of the module. For example, pressurised drilling fluids and drill cuttings are forced around the module. These components are kept safe and in working order by provision of a pressure vessel.

The module may have an aperture sized to allow sufficient flow of cooling fluids through the module. Preferably, the module is annular. Further preferably, the outer diameter (OD) of the module is less than or equal to the OD of the drill string. By providing an aperture for cooling fluids, there is no need for additional passageways from outside the module. As a result, the compactness of the module is maintained by sizing it to be no greater than the drill string outer radial proportions.

The module may include an outer pipe, an inner pipe, and electronics sub-assembly placed between the inner pipe and the outer pipe, wherein the inner pipe is sealingly connected to the outer pipe in order to provide a pressure vessel for said electronics sub-assembly. Preferably, the outer pipe is a drill pipe sub. Preferably, at least one of the inner pipe and the outer pipe is replaceable.

The components forming the module are easy to assemble. The inner pipe and the outer pipe each provide surfaces which are capable of handling corrosive cooling fluids and drilling cuttings being forced around the module. The electronics sub-assembly remains protected inside the pressure vessel formed by the two pipes and two end caps. By using a readily available drill pipe sub which can be mounted inline with the drill string, there is no need to modify the drill bit or other components of the drill string for mounting the module in the drill string. If the inner/outer pipe is excessively damaged such that they may no longer function as a pressure vessel, the pipe(s) may be readily replaced with new component(s).

The electronics sub-assembly may include a processer, a controller, a power source, a data logger and a transmitter. Preferably, there are sensors for measuring strain, temperature, vibration, rotation and displacement. Preferably, one or more of the sensors are mounted in the electronics sub-assembly. Further preferably, there may be provided means for wireless communication of logged data to a computer remote from the module.

The module is thus able to record data from the sensors and to an extent process the data into a useful format. The processed data can be transmitted wirelessly to a remote computer for computing the drilling parameters for the driller's use.

The electronics sub-assembly may be annular for ready positioning between the inner tube and the outer tube. The electronics sub-assembly may need to be removed from the module for servicing. The annular arrangement reduces assembly and disassembly time.

Strain measurement sensor may be mounted separately from the electronics sub-assembly and is connected to the electronics sub-assembly.

Preferably, the strain measurement sensor includes suitably oriented strain gauges bonded to a carrier, and the carrier is bonded to the inner wall of the outer pipe in order to accurately measure strain in the outer pipe. The carrier may be or include a shim.

The carrier may be attached to a carrier mounting means, and wherein rotation of the carrier mounting means relative to the outer pipe is restricted. Preferably, rotation of the carrier mounting means relative to the electronics sub-assembly is restricted.

Strain measurement enables measurement of WOB and torque on bit. Force calculated from the measurement of the strain in the outer pipe of the module, mounted proximate to the drill bit, is approximately equal to the force within the drill bit.

One means of obtaining an accurate strain measurement is to bond the strain gauges to the outer pipe. In order to maintain ease of assembly and disassembly of the electronics sub-assembly, the strain measurement sensor is designed as a separate component of the module.

In order to evenly bond the carrier to the outer pipe, balanced pressure may be applied, such as by a bladder placed behind the carrier and inflated such that it presses the carrier against the inner wall of the outer pipe. Correct bonding between the strain gauge carrier and the outer pipe is very important for accurate strain measurement and also the service life of the module. The proposed method ensures that bonding, for example, by adhesive, is even.

The strain measurement sensor may be positioned such that it covers the electronics sub-assembly, and is connected to the electronics sub-assembly.

The strain measurement sensor may be a flexible metal carrier having strain gauges.

The electronics componentry may be protected by potting a suitable resin at potential drilling muds ingress locations.

The power source may be a battery operated by a switch which is turned on when the electronics sub-assembly is assembled in the module. Even partial disassembly from of the module may shut off the batteries to save battery life.

Preferably, the power source is a battery which is operated when the drill string is detected to be moving and/or rotating to conserve battery life.

The battery may be rechargeable.

The sealing connection between the inner pipe and the outer pipe may be through two spaced apart end caps positioned between the inner pipe and the outer pipe.

Preferably, at least one end cap is made of material through which wireless signals may be transmitted/received from within the module. Alternatively, the outer pipe has a transparent sealed window which allows wireless signals to be transmitted/received from within the module.

The measured parameters may assist in determining at least one of WOB, torque on bit and RPM fluctuations proximate the drill bit, axial and radial vibrations proximate the drill bit, temperature proximate the drill bit, and drilling penetration rate. These measurements are considered to be useful to the driller for monitoring the performance and progress of the drill bit.

A second module may be mounted to a drill string, preferably co-axial therewith, and distal to a drill bit, the second module having sensors for sensing conditions distal to the drill bit.

Differences in the drilling parameters measured by the two modules may be computed to obtain comparative data. Such comparative data may assist in determining at least one of vertical resistance of the drill string, rotational resistance of the drill string, degree of wind-up of the drill string, and the presence of stick-slip conditions at the lower end of the drill string.

Preferably, to get more accurate measurement along the drill string, a plurality of modules may be mounted in the drill string, the modules being spaced apart from each other.

Multiple modules spaced apart in the drill string are useful to calculate axial and rotational frictional losses.

Furthermore, dynamic effects within the drill string can also be measured and analysed by comparing the data proximate to the bit and distal to the drill bit.

A second aspect of the present invention provides a method of measuring drilling parameters of a down-the-hole drilling operation for mineral exploration including the steps of:

- sensing conditions proximate to a drill bit by a first module mounted within a drill string and proximate to the drill bit,
- measuring drilling parameters based on the sensed conditions.

Preferably, the method includes sensing conditions distal to the drill bit by a second module mounted to the drill string and distal to the drill string.

A further aspect of the present invention provides a method of monitoring a down-the-hole drilling operation for mineral exploration including analysing drilling parameters measured by sensing conditions proximate to a drill bit by a first module mounted within a drill string and proximate to the drill bit, measuring drilling parameters based on the sensed conditions.

Preferably, the method includes comparing drilling parameters measured by the first module proximate to the drill bit with drilling parameters measured by the second module distal to the drill bit.

BRIEF DESCRIPTION OF THE DRAWINGS

Further advantages of the present invention will emerge from a description which follows of the preferred embodiment of an apparatus for measuring drilling parameters of a down-the-hole drilling operation for mineral exploration, according to the invention, given with reference to the accompanying drawing figures, in which.

DESCRIPTION OF PREFERRED EMBODIMENT

Figure 1:
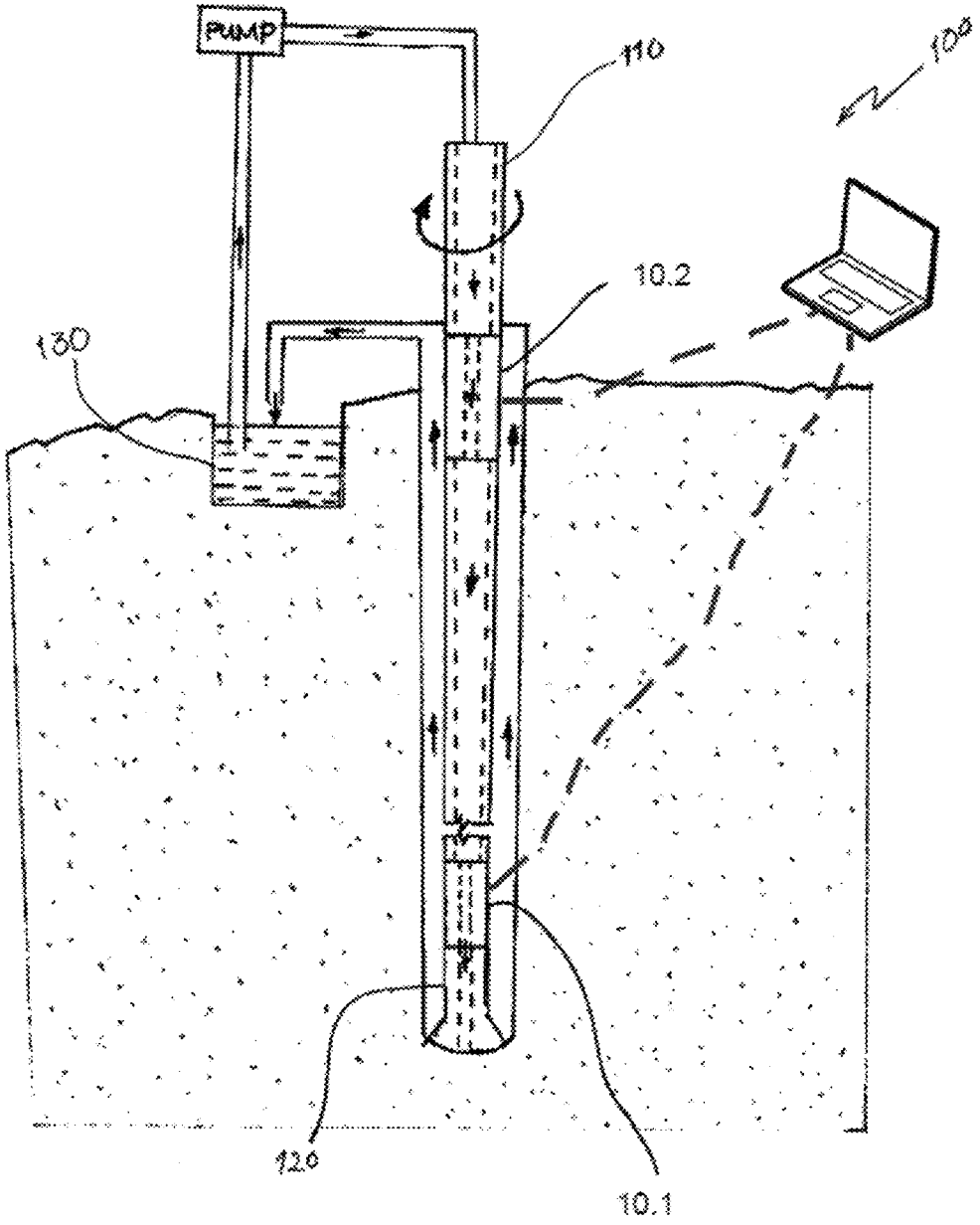
FIG. 1 shows a schematic view of two modules installed in a drill string according to an embodiment of the present invention.
Figure 2:
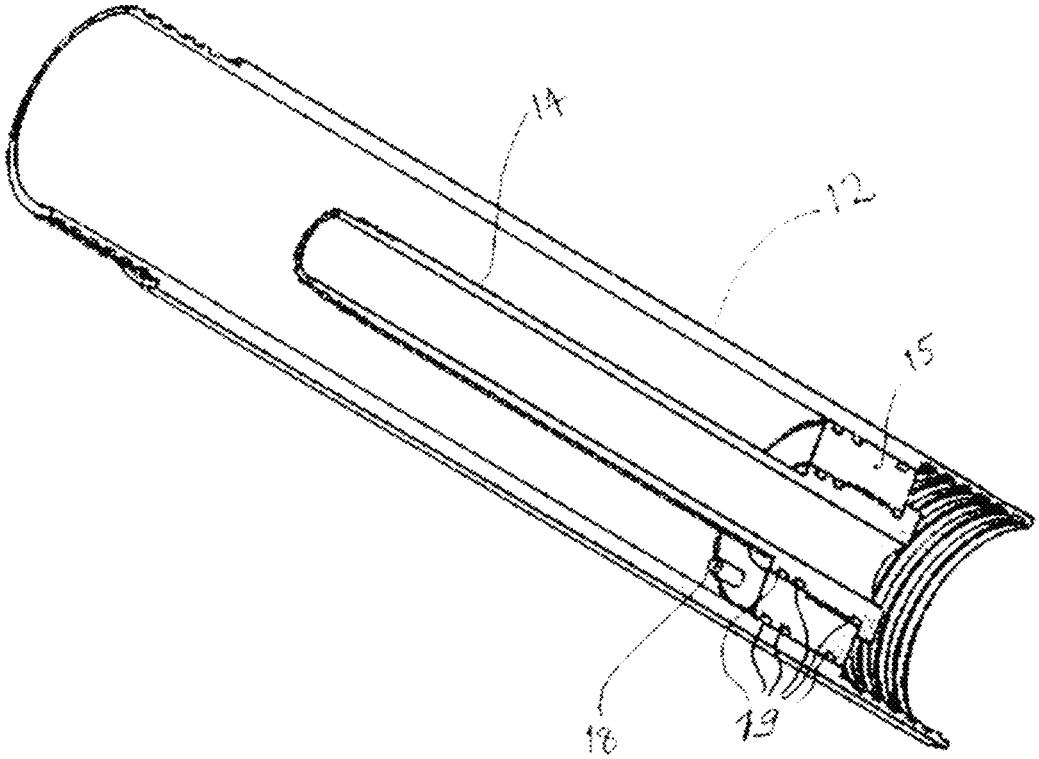
FIGS. 2 to 5 show sectional views of the module according to a first embodiment of the present invention. Each of FIGS. 2 to 5 shows different components of the module to illustrate progressive assembly of the module.
Figure 3:
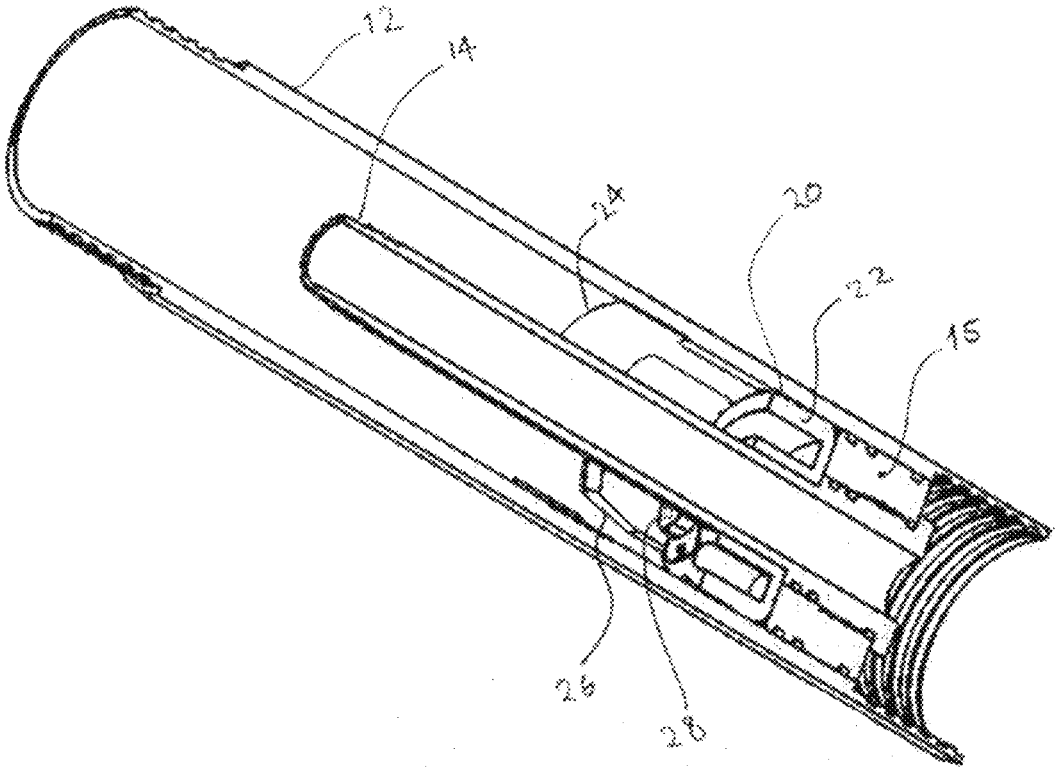
Figure 4:
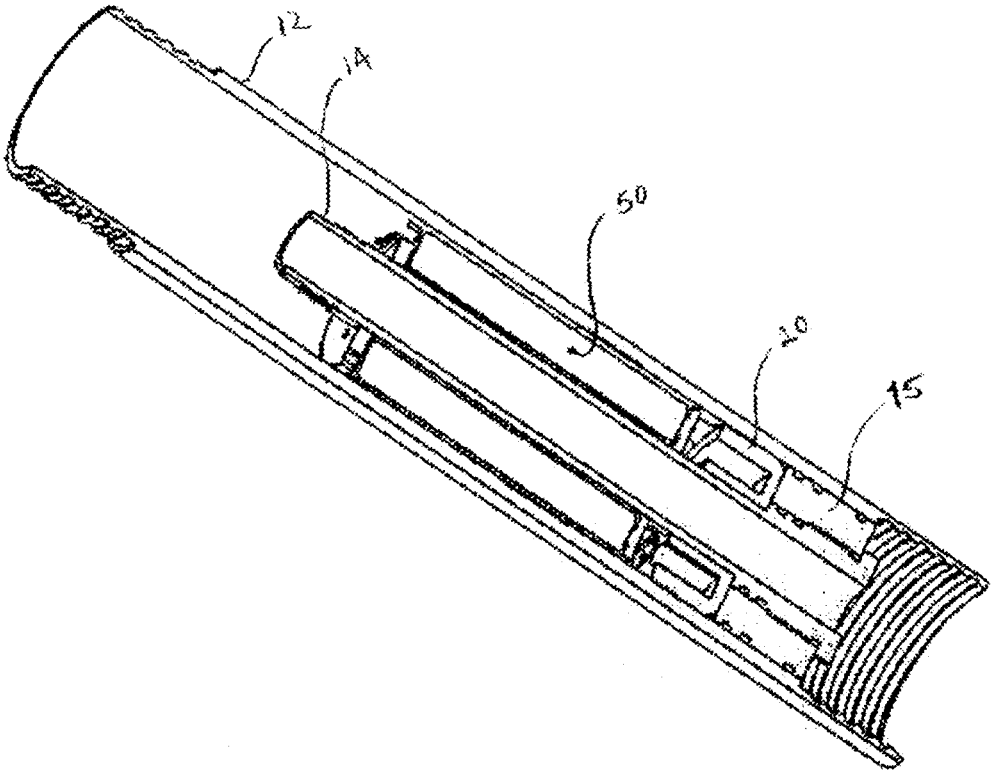
Figure 5:
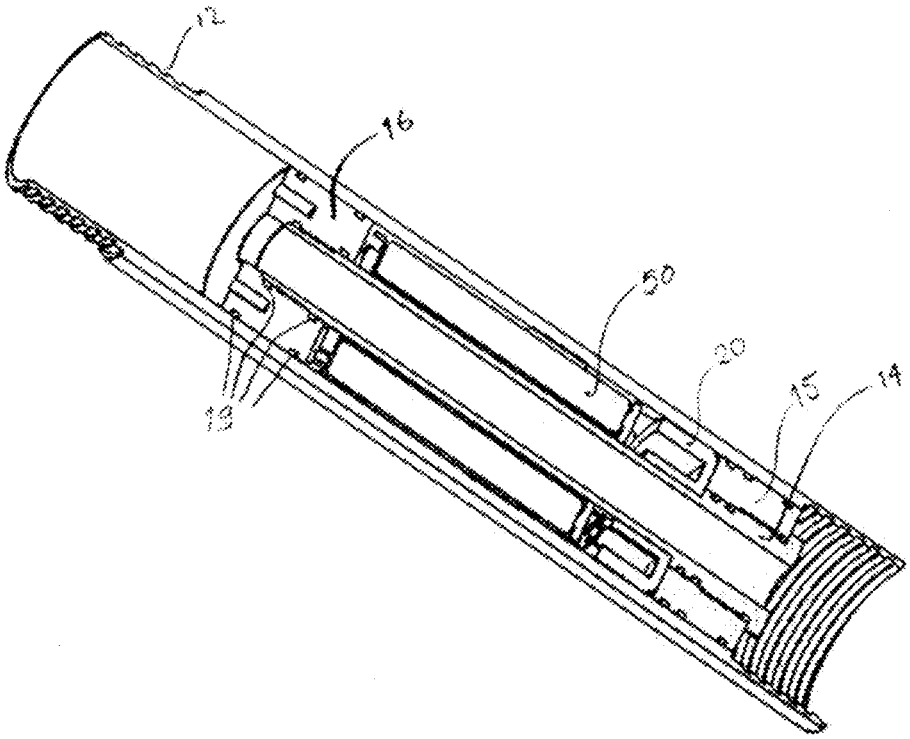

Referring to FIG. 1, apparatus 100 for measuring drilling parameters of a down-the-hole drilling operation for mineral exploration includes a module 10 (10.1) mounted in-line with a drill string 110 and proximate to a drill bit 120. The drill string 110 is rotated and progressed down the hole.

The module 10 has sensors for sensing conditions. The apparatus 100 measures drilling parameters based on the sensed conditions. The measured data is logged in the module 10 and then transmitted to a computer for a drilling operator's use. The drilling operator monitors progress and optimises performance of the drilling operation based on the measured data.

Measurement of drilling parameters based on sensed data proximate to the drill bit enables accurate determination of:

- Actual WOB (alleviates the need to estimate for several unknown parameters)
- Torque and RPM fluctuations (these may be caused due to vibration or stick-slip conditions, torque fluctuations can lead to increased fatigue levels of components such as the drill rods)
- Axial vibration (axial vibration results in variable normal loads on the cutting face of the bit, leading to sub-optimal cutting and abnormal wear of diamonds and matrix)
- Radial vibration (radial vibration can lead to deflection of the hole from its desired path and undersize core diameter, leading to difficulties with the core lifter and core retrieval)
- Temperature (temperature can provide feedback on flow as there will be correlation between mud flow and its temperature. This provides diagnostic feedback if problems with burning of bits is encountered)
- RPM (rpm provides a time stamped record that may be compared with drilling rate as a means of optimising penetration rate/learning after the drilling of the hole)

A second module 10 (10.2) is mounted in-line with the same drill string 110 but away from the drill bit 120. The second module 10 measures the same drilling parameters as the module 10 proximate to the drill bit 120. The driller is provided with the data recorded by the second module 10 to judge the performance of the drilling operation.

Comparing drilling parameters based on sensed data proximate to the drill bit and distal to the drill bit enables accurate determination of:

- vertical drag/resistance of the drill string 110 within the hole
- rotational resistance of the drill string 110
- degree of wind-up of the drill string 110
- presence of stick-slip conditions at lower end of the drill string 110

Module 10 According to a First Embodiment

The module 10 has to operate in very harsh conditions. Drilling fluids 130, such as compressed air, water, or mud, are pumped through the drill string 110 and the module 10 to the drill bit 120 face to act as a cooling media. Drill cuttings are pushed out from between the drill string 110 and the hole by the drilling fluids 130. Since drilling fluids are recirculated, the drilling fluids 130 being pumped through the drill string include abrasive drill cuttings.

Further, the drilling fluids 110 may include extremely corrosive elements such as additives or ground water. The module 10 bears abrasion from the incoming and outgoing mixture of drilling fluids and drill cuttings. In addition, the drill bit 120 may drill holes having depths in excess of 1.5 km. Some drilling muds have specific gravity as high as 1.5 which increase the resultant ambient pressure around the drill bit to about 225 Bars (3400 psi).

The module 10 is designed to withstand these harsh conditions and to provide a cocoon for the sensors and other electronics of the module 10. In other words, the module 10 is a pressure vessel protecting its sensors and electronic components from outside pressurised wet cooling fluids 130.

The module 10 needs to be suitable to operate in a hole meant for mineral exploration which is a lot smaller than a hole for oil and gas exploration. Space constraints are therefore severe.

The drill pipes forming the drill string for mineral exploration may be of NQ size which is 69.9 mm OD and 60.30 mm inside diameter. Firstly, the module 10 has the same OD as that of other subs of the drill string 110 so that it does not restrict movement of the drill string 110 in the hole.

Secondly, the module 10 provides an internal conduit which allows sufficient volumetric flow of cooling fluids while not exceeding a maximum permissible pressure loss through the conduit.

Additionally, the wall thickness of the cocoon for sensors and electronics needs to be such that aforementioned harsh conditions are withstood by the module 10 at least over its service life. Consequently, the module 10 is built in an annular structure which has severe limitations on its outside diameter, inside diameter, length, and wall thickness.

The module 10 is designed to withstand maximum axial compressive force which comprises full weight of the drill string 110 and the maximum down force applied by the hydraulic cylinders on the drill string 110. Typically, a 1.5 km long, NQ size drill string weighs around 11,700 kg. For a typical drill rig suitable for handling such a 1.5 km long drill string, the maximum thrust rating may be 12,000 kg and maximum pull-back about 23,000 kg.

The maximum torque applied by such a rig on 1.5 km long drill string 110 is around 2000 N-m (in high gear, <2000 rpm) and 14,000 N-m (in low gear, <200 rpm). Torsional resistance is provided on the module 10 by the cooling fluids 130. Rotational force/wear also needs to be considered when designing the module 10. However, rotational force/wear is of lesser importance than axial compressive force when designing the module 10.

The module 10 contains the following electronics components:

- Strain: wheatstone bridges for measurement of strain in conjunction with bonded strain gauges and provision for temperature compensation
- Temperature: on-board temperature measurement and recording by means such as thermocouple, SST probe
- Vibration, orientation, rpm: tri-axial accelerometer for measurement of vibration, rotation, displacement (via integration)—may measure 10's or 100's of G's (1 G=9.81 m/s$^2$)
- Memory: at least 8 MB
- Time stamping of data: to enable correlation with drilling events
- Signal processing capability such as FFT
- Calibration factors for engineering unit output
- Programmable (E$^2$ROM or suchlike) configurable parameter setup
- Sampling frequency 1<f<512 Hz
- Wireless Communication (2.4 GHz)
- Communication to a PC via a base station—wired or wireless e.g. Bluetooth
- Battery: 3.6V Primary Thionyl Chloride pack 37.4 W-h capacity×2, the battery may be re-chargeable.

Also provided in the apparatus 100 is a computer interface such as a graphic user interface, to download data logged by the module 10 and objectively analyse downloaded data. The computer interface is able to communicate with the module to set the following parameters:

- Channels being logged
- Real time streaming of data or recording
- Logging frequency
- Logging trigger or delays
- Calibration factors for the various channels
- Channel range (HI/LO) to optimise accuracy and resolution
- Downloaded data format Referring to FIGS. 2 to 9, the module 10 is a pressure vessel for electronics sub-assembly 50 connected to a strain sensing unit 20. These components 50, 20 of the module 10 need to be isolated from the wet abrasive cooling fluids which can cause severe damage to components 50, 20. The components of the module 10 forming the pressure vessel include an outer pipe 12 sealingly connected to an inner pipe 14 by means of end caps 15, 16 at opposite ends of the inner pipe 14. The seal is provided by multiple sealing members 19 such as O-rings, between the inside surface of the end caps 15, 16 and the outside surface of the end caps 15, 16 and the outer pipe 12.

The outer pipe 12 is a NQ size drill sub having outer 69.9 mm and 300 mm length. The short length of the module 10 i.e. length of the outer pipe 12 helps reduce the pressure drop of the cooling fluids travelling inside the module 10. The outer pipe 12 has external threading at one end and internal threading at the other end, which suit threading on other pipes of the drill string 110. The module 10 can therefore be readily mounted in-line with the drill string 110 without exceeding the outer dimensions of the drill string 110. Also, the drill sub is rated for the loads and conditions on the drill string.

The outer pipe 12 is made of steel grade ASTM4140. However, steel of other grades or other alloys may also be used.

The inner diameter (ID) of the inner pipe 14 allows sufficient volumetric flow of cooling fluids whilst not exceeding the maximum permissible pressure drop. The inner pipe 14 is durable enough to last its service life. The inner pipe 14 is shorter than the outer pipe 12 further reduce the pressure drop of the cooling fluids travelling inside the module 10. The inner pipe 14 has external threading on both its ends. External threading at first end of the inner pipe 14 is for fastening the first end cap 15. External threading at the second end of the inner pipe 14 is for fastening the second end cap 16. At the first end, the OD of the inner pipe 14 is increased in two steps. The first step increase in OD of the inner pipe 14 is to provide a face for partially supporting for the sensing unit 20. The next step increase in OD of the inner pipe 14 is to form a collar at the very end of the inner pipe 14 for engagement with the first end cap 15. Further, the inner pipe 14 is provided with multiple grooves adjacent the external threaded portions for supporting multiple O-rings 19. Grooves for O-rings are provided on either side of each external threading of the inner pipe 14 in order to prevent corrosion or binding of the thread in the assembled state.

The inner pipe provides a reduced passageway for cooling fluids (as ID of other drill string 110 pipes is just their OD less thickness). On the other hand the outer pipe 12 does not obstruct the flow of cooling fluids between the drill string and the drill hole wall (as the outer pipe is of the same size as other drill string 110 pipes). As a result, the inner pipe 14 is more prone to failing than the outer pipe 12. Therefore, the inner pipe 14 is replaceable.

The inner pipe 14 is made of similar material as that of the outer pipe 12. ASTM4140 steel is a preferred material for the inner pipe 14 because this material can be readily heat treated, for example induction hardened, in order to maximise its wear resistance. Other alloys having similar wear resistance characteristics may be used instead.

The first end cap 15 and the second end cap 16 are annular discs. OD of the end caps 15, 16 is equal to the ID of the outer pipe. ID of the first end cap 15 is equal to the first step increased OD or the intermediate OD of the inner pipe 14. ID of the second end cap 16 is equal to the smallest OD of the inner pipe 14. First end cap 15 and second end cap 16 have internal threading corresponding to the external threading at the first end of the inner pipe 14 and the second end of the inner pipe 14, respectively. Grooves are provided on the outer and inner cylindrical surfaces of the end caps 15, 16 for accommodating O-rings 19.

The first end cap 15 has tapped holes on its outer cylindrical surface to receive fasteners for attachment with the outer pipe 12. Locating pins 18 are positioned on one flat surface of the first end cap 15 for insertion in corresponding recess in the strain sensing unit 20 to restrict rotation of the strain sensing unit 20 relative to the outer pipe 12.

The first end cap 15 is also preferably made of ASTM4140. However, as the first end cap 15 is not highly stressed, most other grades of steel may be used to manufacture the first end cap 15. An important characteristic of material used for the first end cap 15 is that the material should have a degree of corrosion resistance, particularly since the first end cap is not designed to be readily replaced. Corrosion resistance may be obtained by a specific material, or by passivation of the surface of the first end cap 15 which comes in contact with drilling muds.

Second end cap 16 has two recesses on one of its flat faces to receive a tool for rotating the second end cap 16 when the second end cap 16 is inside the outer pipe 12. The important material characteristic of the second end cap 16 is that it needs to be non-conductive and/or non-metallic in nature, to allow transmission/reception of RF signals from inside the module 10. The second end cap 16 is made of transparent plastic material such as acetal or Delrin™.

Figure 7:
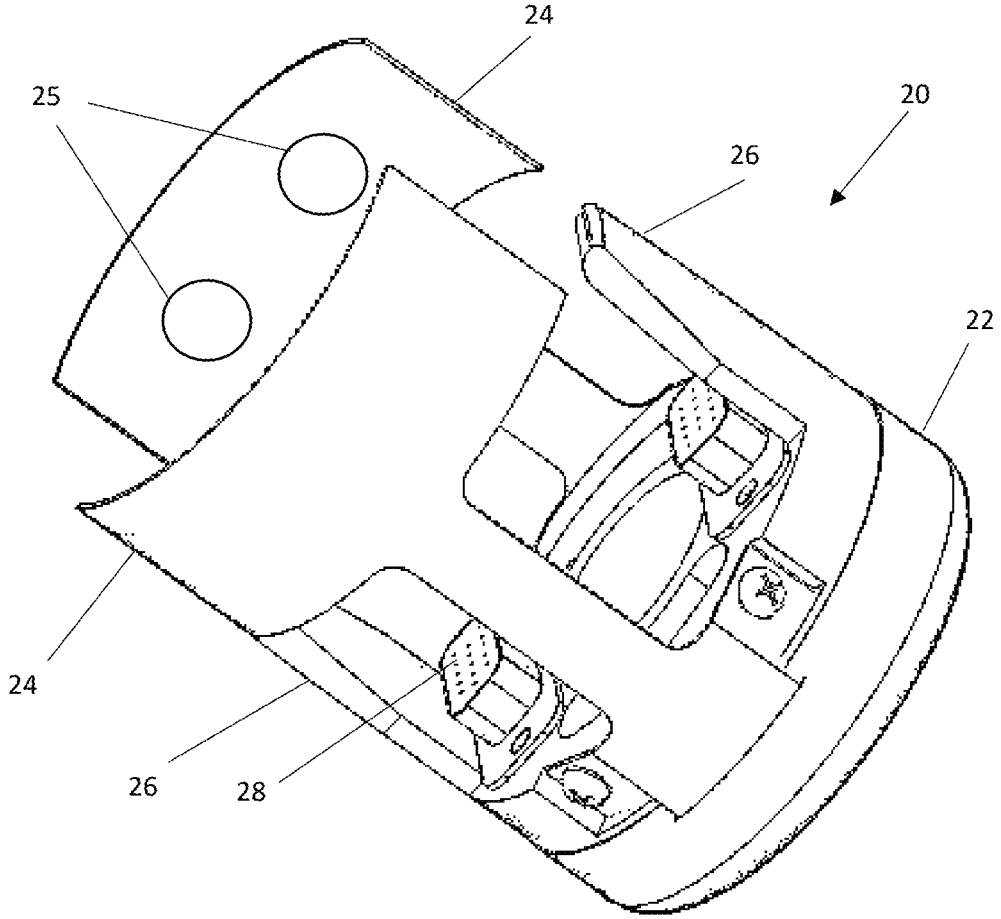
FIG. 7 shows an isometric view of a strain sensor unit according to a first embodiment of the present invention.
Figure 8:
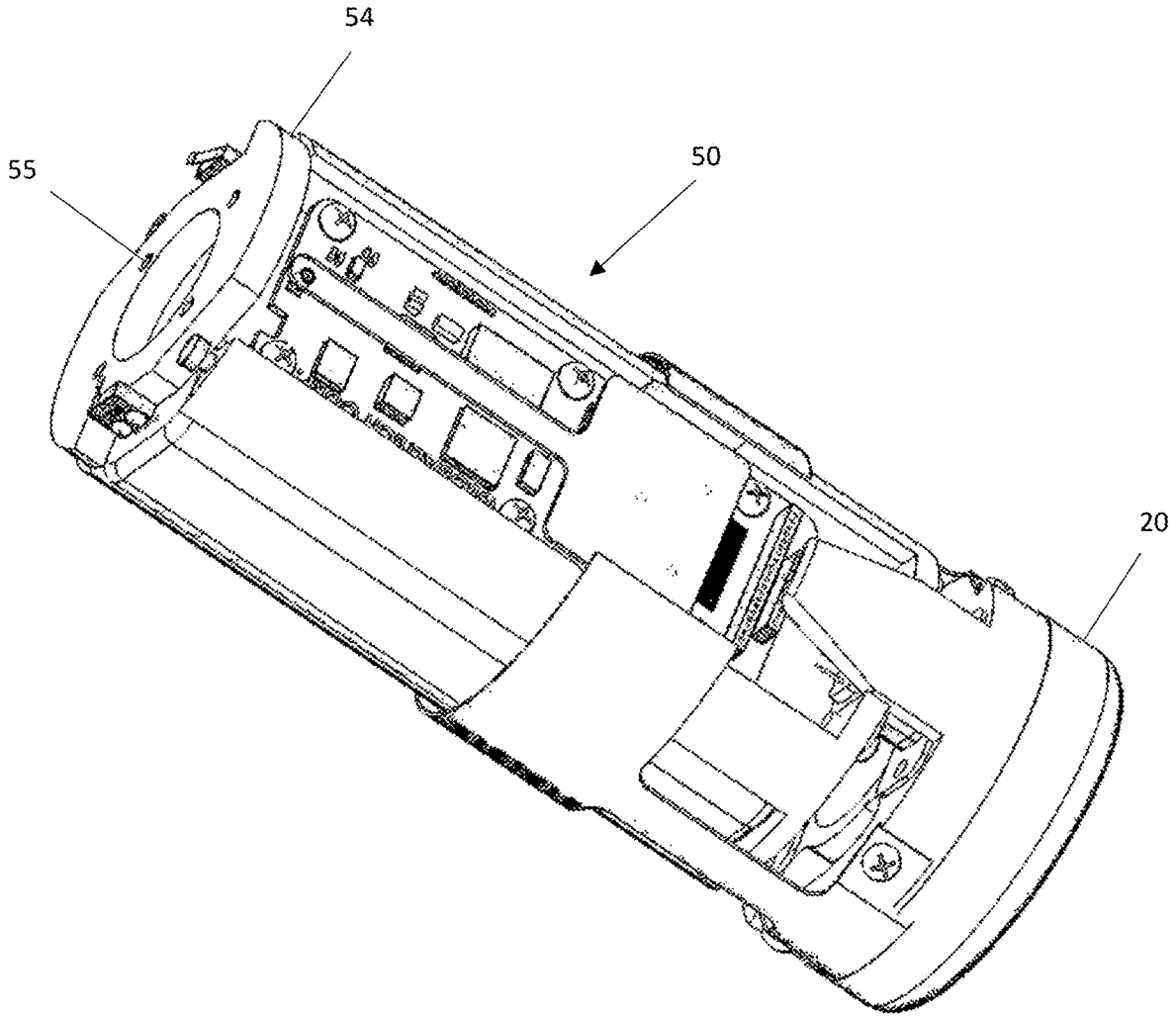
FIG. 8 shows an isometric view of an electronics sub-assembly connected to a strain sensor unit according to a first embodiment of the present invention.
Figure 9:
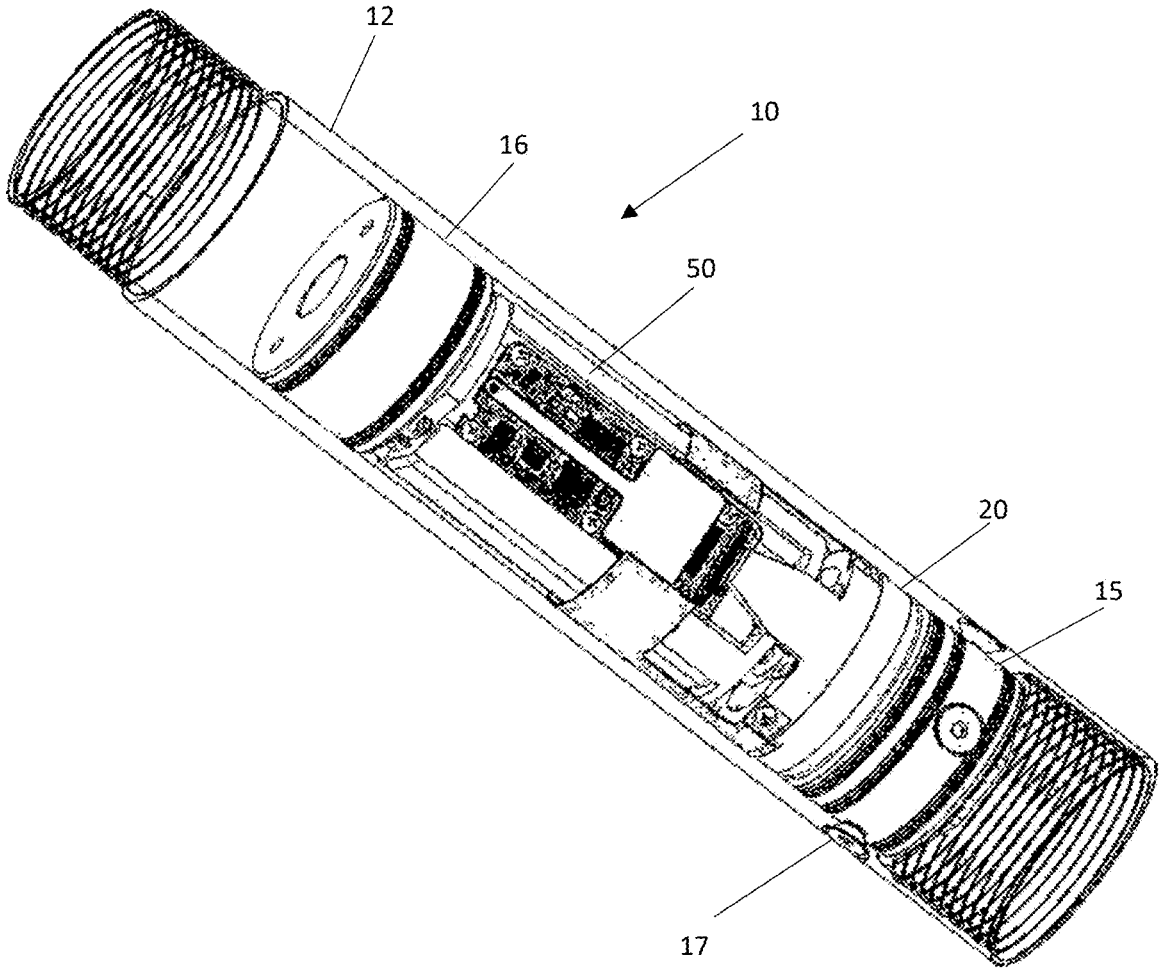
FIG. 9 shows an isometric view of a module according to a first embodiment of the present invention.
Figure 10:
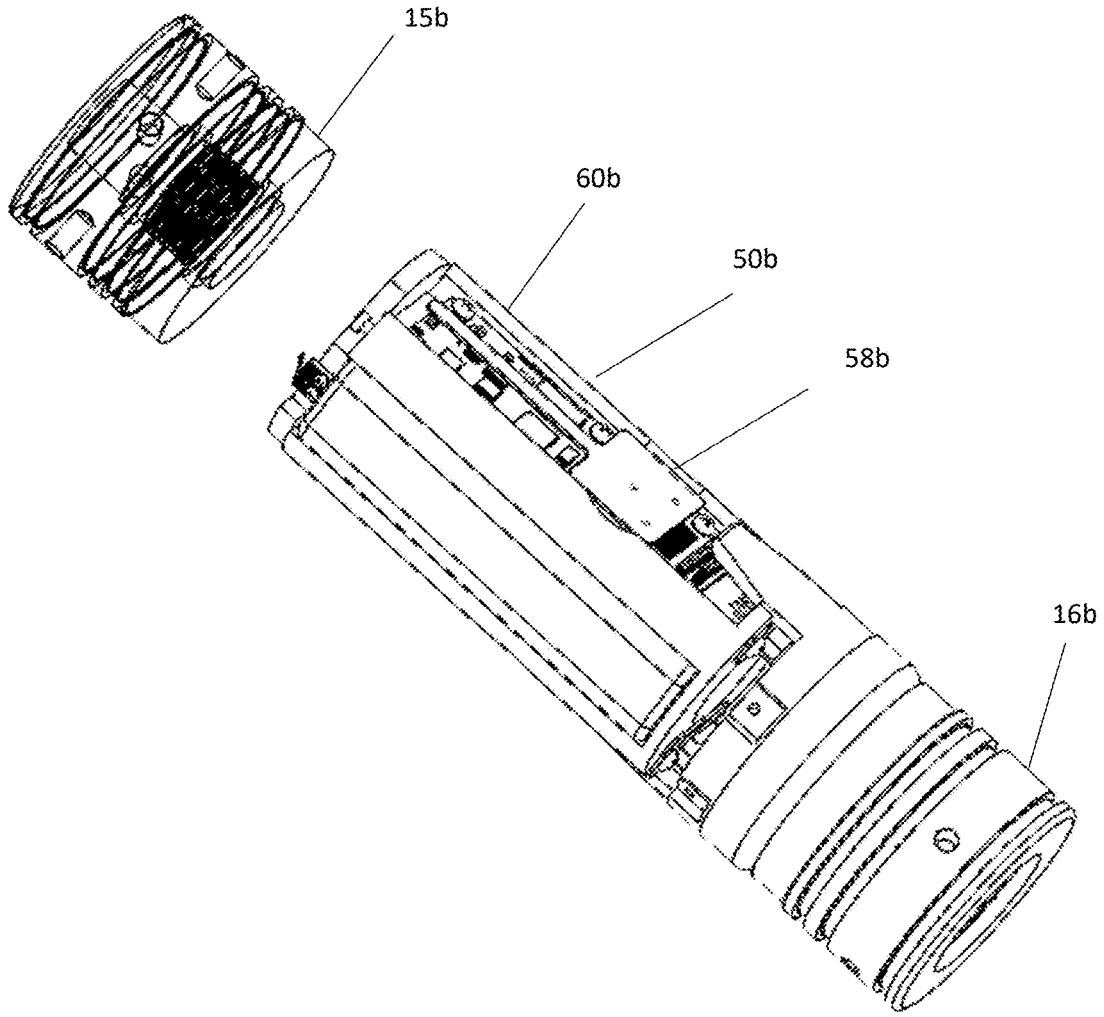
FIG. 10 shows an isometric view of an electronics sub-assembly and two end caps according to a second embodiment of the present invention.
Figure 11:
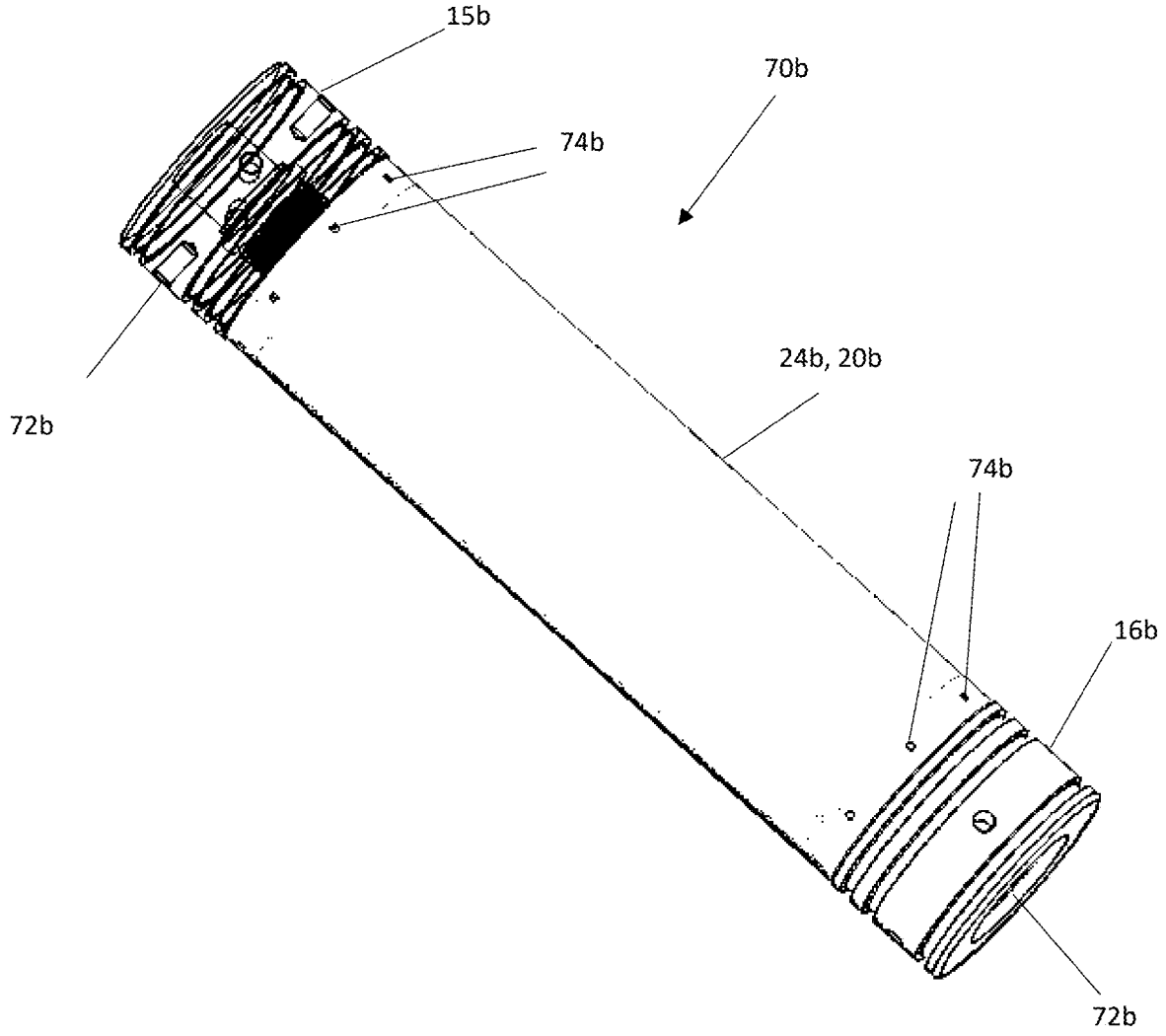
FIG. 11 shows an isometric view of a strain sensing unit mounted on the electronics sub-assembly according to a second embodiment of the present invention.
Figure 12:
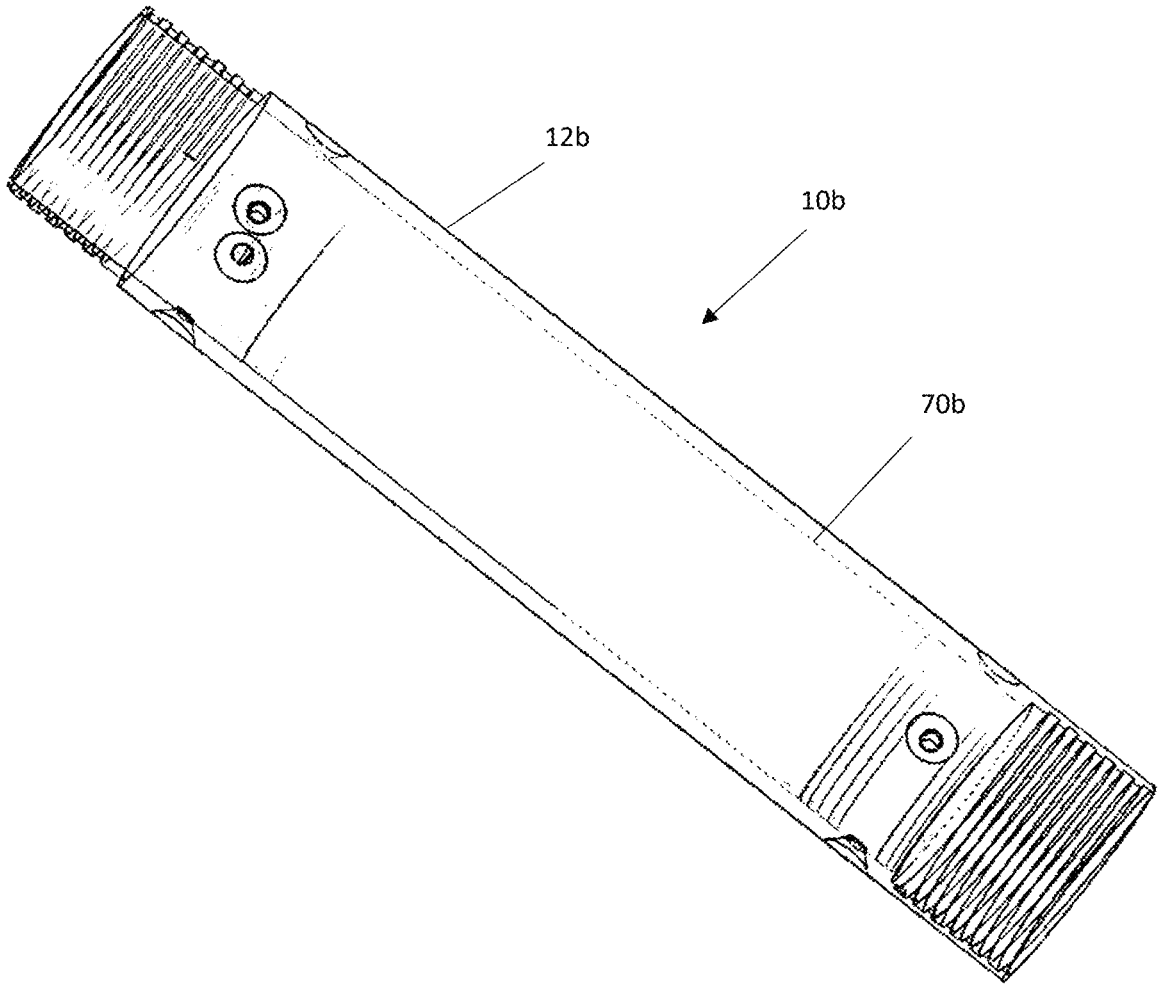
FIG. 12 shows an isometric view of assembly of FIG. 11 positioned in an outer pipe, the outer pipe being shown partially see-through, according to a second embodiment of the present invention.
Figure 13:
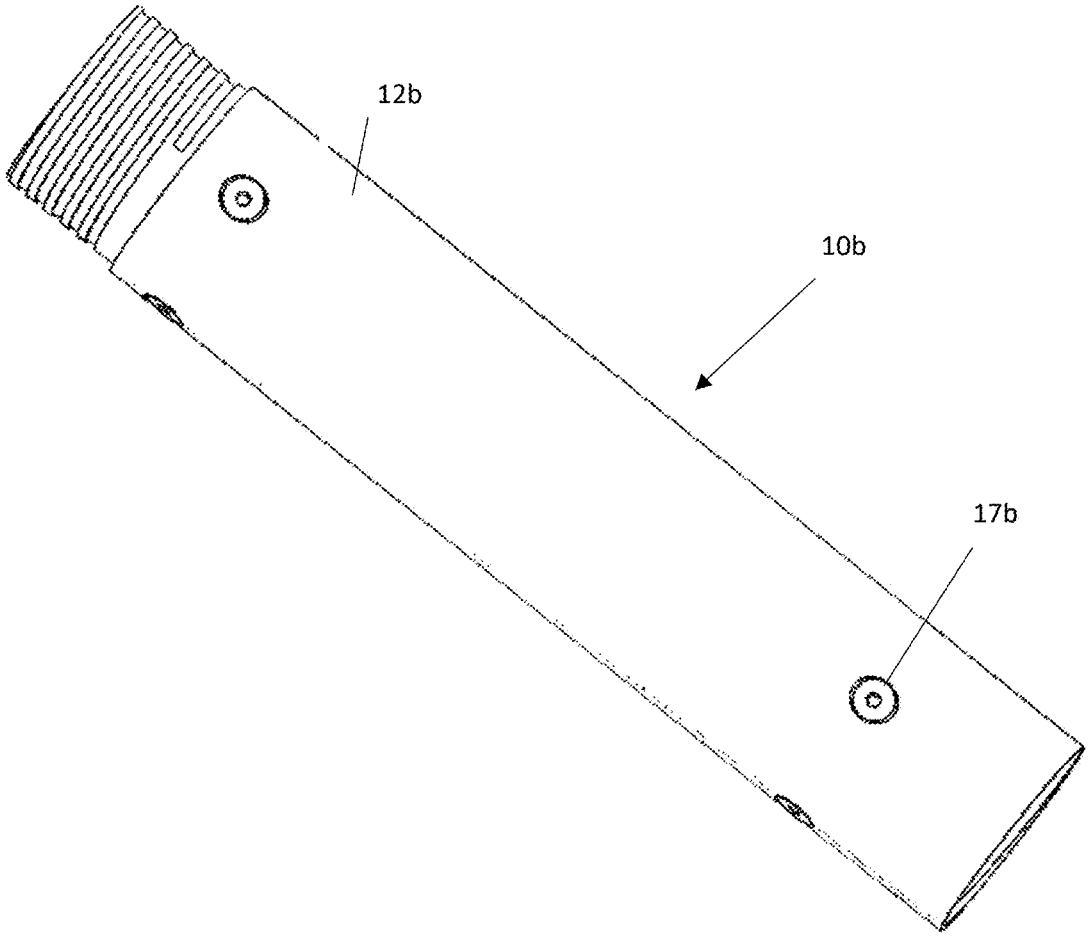
FIG. 13 shows an isometric view of a module according to a second embodiment of the present invention.

Referring to FIG. 7, the strain sensing unit 20 includes rosette strain gauges 25 bonded to inside faces (i.e. faces facing the inner pipe) of oppositely position carriers 24. Carriers 24 allow correct orientation and bonding of the strain gauges 25 inside the outer pipe 12. Strain gauges 25 are suitably and carefully oriented on the carriers 24. Carriers 24 are thin steel shims. The carriers 24 are to be bonded to the inner wall of the outer pipe 12 to measure strain in the outer pipe 12. The strain gauges 25 should be able to sense the strain present in the outer pipe 12. The measured strain must be independent of that induced by applied hydrostatic pressure differential or some means of mechanical or electronic compensation should be provided.

Carriers 24 are fastened on to an annular support 22. The strain gauges 25 are wired to connectors 28 on the support 22 to transmit data sensed by the strain gauges 25 to the electronics sub-assembly 50 where the data is processed to measure strain and recorded. The surface of the carriers 24 to which the strain gauges 25 are bonded and wiring harness connecting the strain gauges 25 to the connectors 28 are sprayed with a conformal protective coating. All components of the strain sensing unit 20 are bonded together.

The two connectors 28 are located at opposite sides of the support 22. The connectors 28 are spaced from the carriers 24 such that each connector 28 and each carrier 24 is in a different quadrant of the annular support 22. The connectors 28 are equi-spaced from the carriers 24.

The support 22 is annular in order to be mounted between the outer pipe 12 and inner pipe 14. For assembly, the support 22 has locating recesses to receive locating pins 18 of the first end cap 15. Two oppositely positioned projections 26 are provided to guide the electronics sub-assembly 50. The projections 26 are located in the quadrant of the connectors 28 so that they do not interfere with the carriers 24 during assembly.

Figure 6:
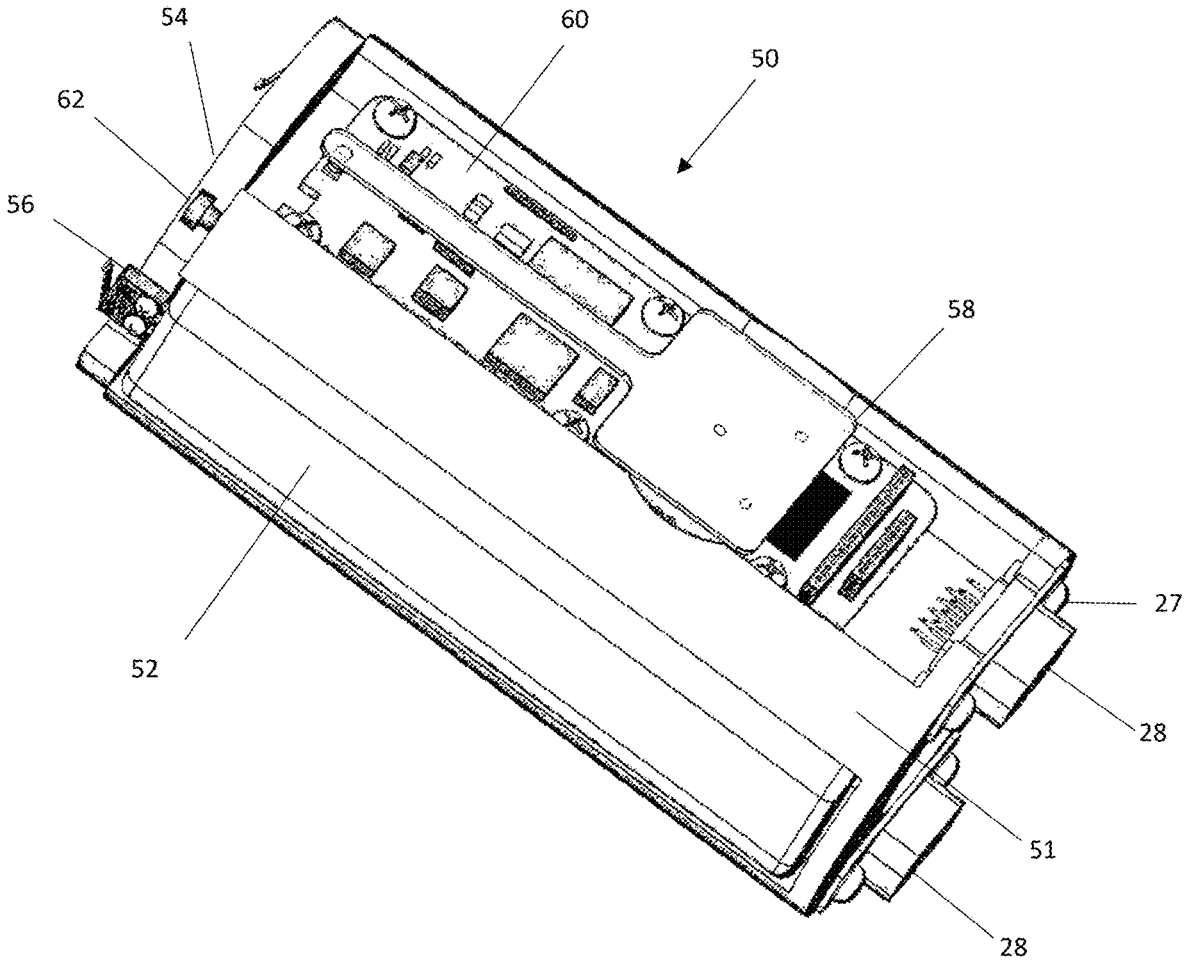
FIG. 6 shows an isometric view of an electronics sub-assembly according to a first embodiment of the present invention.

Referring to FIG. 6, the electronics sub-assembly 50 is annular to be mounted between the outer pipe 12 and inner pipe 14. Plastic housing 51 forms the main framework of the electronics sub-assembly 50. The housing 51 splits the electronics sub-assembly 50 into four quadrants.

Two batteries 52 power the components of the electronics sub-assembly 50. Long life batteries such as Li-ion batteries are selected to provide long service life. The batteries 52 are located in opposite quadrants of the electronics sub-assembly 50.

Electronic componentry including motherboard 60 for housing sensors such as accelerometer and thermocouple, processor, and data logger, are positioned in the remaining two oppositely located quadrants of the electronics sub-assembly 50.

The Electronic componentry on the two sides may be independent and identical to provide redundancy in case one of them fails.

The batteries 52 are slidably placed in the housing 51 such that they are supported by the base of the housing 51. At a second end of the electronics sub-assembly 50, the batteries 52 are locked in place by means of an end plate 54 fastened to the housing 51.

End plate 54 is provided with locating holes or recesses 54 to receive corresponding locating projections of the housing 51 in order to correctly orient the end-cap 55 relative to the housing 51.

A micro-switch 56 is provided for each battery 52 at the second end. The micro-switches 56 complete the electrical circuit between the batteries 52 and the electronic components, only when the electronics sub-assembly is completely assembled in the module 10 in order to conserve battery power at times such as during maintenance of the module 10.

Also provided at the first end, are two extraction aids 62. Extraction aids 62 are set screws partially inserted in and projecting from the first end of the housing 51. Extraction aids 61 are provided to be hooked on by a tool for removing the electronics sub-assembly 50 from the module 10.

Connectors 28 are provided at the first end of the electronics sub-assembly 50 for connection with the corresponding connectors 28 located on the strain sensing unit 20. Also provided at the first end of the electronics sub-assembly 50 are guides 27, in form of appropriately shaped recesses, for guiding the projections 26 of the strain sensing unit 20.

Assembly of the Module According to the First Embodiment

Referring to FIGS. 2 to 5, in order to assemble the module 10 the following steps are performed.

Initially, the annular first end cap 15 having sealing members 19 on its OD and ID is mounted inside of the outer pipe 12, at the first end of the outer pipe 12, by means fasteners 17 such as counter sunk screws. Counter sunk screws ensure that the outer dimensions of the module 10 are not exceeded from the OD of the outer pipe 12.

Subsequently, first end of the inner pipe 14 is screwed in the first end cap 15 until the collar of the inner pipe rests on the first end cap 15.

Subsequently, strain sensing unit 20 is inserted in the outer pipe 12 and over the inner pipe 14 until the strain sensing unit 20 is supported by the first end cap 15 and a flat face of the inner pipe 12. Locating pins 18 of the first end cap 15 insert in the locating recess on the strain sensing unit 20.

An adhesive is put between the carriers 24 and the inner wall of the outer pipe 12.

A bladder is inflated and pressurised (to about 2 bar) inside the module 10, until the adhesive is completely cured, so that the carriers 24 are evenly bonded with the outer pipe 12. Such intimate bonding ensures that strain in the outer pipe 12 is correctly recorded by the strain gauges 25 on the carriers 24.

Subsequently, electronics sub-assembly 50 is inserted in the outer pipe 12 and over the inner pipe 14 until the connectors 28 on the electronics sub-assembly 50 are connected to those on the strain sensing unit 20.

Orientation of the electronics sub-assembly 50 is dictated by the engagement of the projection 26 on the strain sensing unit 50 and the corresponding guide recess 27 on the electronics sub-assembly.

Finally, the annular second end cap 16 is screwed at the second end of the inner pipe 14 such O-rings at the outer and inner cylindrical surfaces of the second end cap 16 act as sealing members.

Final turns of the second end cap 16 causes axial movement of the second end cap to activate the micro-switches 56 to complete the electrical circuit such that the batteries power the electronics inside the module 10 and the module is switched ON.

The reverse rotation of the second end cap 16 disconnects the batteries from the electronics. Batteries can be easily disconnected to maximise battery life.

As mentioned earlier, the inner pipe 14 is subject to severe wearing and therefore is a replaceable part. The pitch of the threads at the first end of inner pipe 14 is equal to that of the threads at its second end. Therefore, from an assembled module, the inner pipe 14 can be rotated to be disengaged from both the end caps 15, 16.

A replacement inner pipe 14 can be inserted and screwed to the two end caps 15, 16. No components of the module 10 are disturbed when removing a worn out inner tube 14 or inserting a new inner tube 14. However, care needs to be taken to ensure that integrity of the sealing members 19 is maintained when replacing the inner tube 12.

To replace the batteries 52, the second end cap 16 is unscrewed from the inner pipe 14 and removed. The electronics sub-assembly 50 is pulled out of the module 10.

The end plate 54 is unfastened from the housing 51. Used batteries 52 are removed and new batteries 52 are inserted.

Module 10B According to a Second Embodiment

The following description is limited to the distinctive features of the module 10*b* of the second embodiment as compared to the module 10 as per the first embodiment, to avoid repetition.

Referring to FIGS. 10 to 13, in a second embodiment the module 10*b* includes a load cell 70*b* mounted in the outer tube 12*b*. The load cell 70*b* comprises a first end cap 15*b*, an electronics sub-assembly 50*b*, a second end cap 16*b*, and a carrier 24*b* of strain gauges.

The electronics sub-assembly 50*b* has the electrical/electronics components such as mother board 60*b* (having some sensors, processor and memory), RF antenna 58*b*, and battery.

The first end cap 15*b*, the electronics sub-assembly 50*b*, and the second end cap 16*b* are mounted on the inner pipe 14*b* (not shown).

The carrier 24*b* is a flexible metal shim of rectangular shape. The carrier 24*b* is sized such that when positioned on the cylindrical assembly of the electronics sub-assembly 50*b* and the two end caps 15*b*, 16*b*, the carrier 24*b* encompasses the entire circumference.

Strain gauges are bonded to the surface of the carrier 24*b* which is proximate to the electronics sub-assembly i.e. the surface which is hidden after the carrier 24*b* is mounted. It is easier to mount the strain gauges on a flat metal sheet. The strain gauges are in wired communication with the electronics sub-assembly 50*b*. The carrier 24*b*, the strain gauges and the wired communication form the strain sensing unit 20*b*.

For mounting the carrier 24*b*, the carrier 24*b* is placed on the assembly of the electronics sub-assembly 50*b* and the two end caps 15*b*, 16*b*. The carrier 24*b* is flexed such that it covers the electronics sub-assembly 50*b*. At one end, the carrier 24*b* is fastened to the first end cap 15*b* by means of fasteners 74*b*. At the opposite end, the carrier is fastened to the second end cap 15*b* by means of fasteners 74*b*. Once the carrier 24*b* is mounted, the load cell 70*b* is formed.

Both the end caps 15*b*, 16*b* have recesses 72*b* (e.g. tapped holes) to receive fasteners 17*b* for mounting the load cell 70*b* inside the outer pipe 12*b*. The load cell 70*b* is placed in the outer pipe 12*b*, and four fasteners 17*b* (e.g. counter sunk screws) at each end fasten the load cell 70*b* to the outer pipe 12*b*.

Fasteners 74*b* mounting the carrier 24*b* on the two end caps 15*b*, 16*b* are spaced from the fasteners 17*b* mounting the outer pipe 12*b* on the two end caps 15*b*, 16*b*.

Preferably there is a clearance fit between the load cell 70*b* and the outer pipe 12*b*. However, there may be a sliding fit between the load cell 70*b* and the outer pipe 12*b* for ease of assembly.

Sealing members may be provided to prevent ingress of drilling muds between the load cell 70*b* and the outer pipe 12*b*. Alternatively, sealing may be provided between the carrier 24*b* and the two end caps 15*b*, 16*b* to protect the electronics componentry.

The load cell 70*b* may be potted with resin to prevent ingress of drilling muds to the sensitive electronics components.

The battery provided in the load cell 70*b* is rechargeable. The battery may be charged via a sealed connector. The battery may be charged between drilling rounds, if required.

In use, the strain is transmitted from the outer pipe 12*b* to the load cell 70*b* through the mounting fasteners 17*b*. Sensed strain is processed and recorded on the on-board memory along with other sensed conditions.

The load cell 70*b* is a sealed removable annular cylinder which is not required to be removed unless damaged. It can be readily removed repair or replacement. Access to components of the load cell 70*b* is better than that of first embodiment, for example the carrier 24*b* is easier to repair/replace than that of the first embodiment because carrier 24*b* is not bonded to the outer pipe 12*b*.

Figure 14:
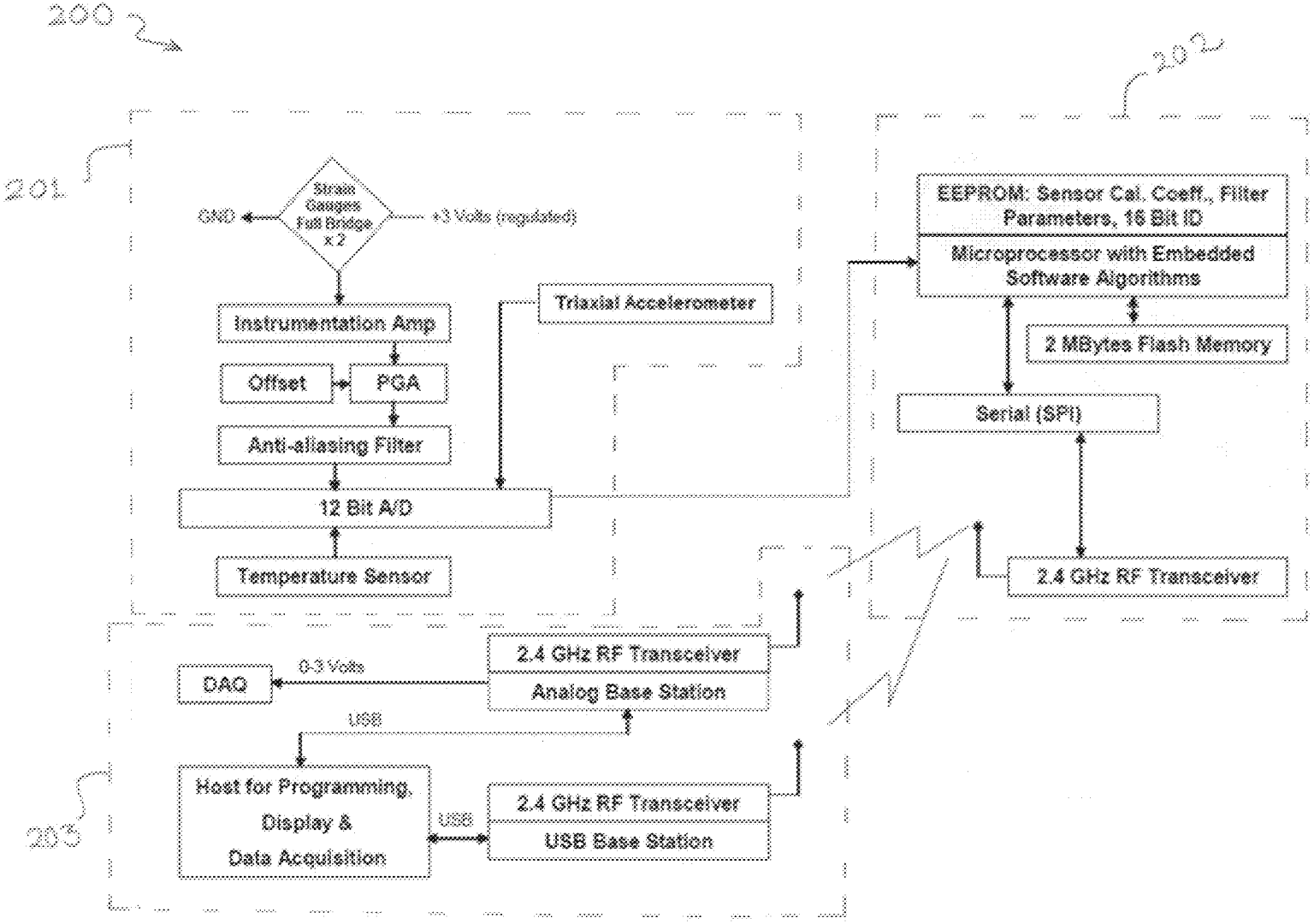
FIG. 14 shows electrical/electronic configuration for logging sensed data and communicating the logged data as per one embodiment of the present invention.
Figure 15:
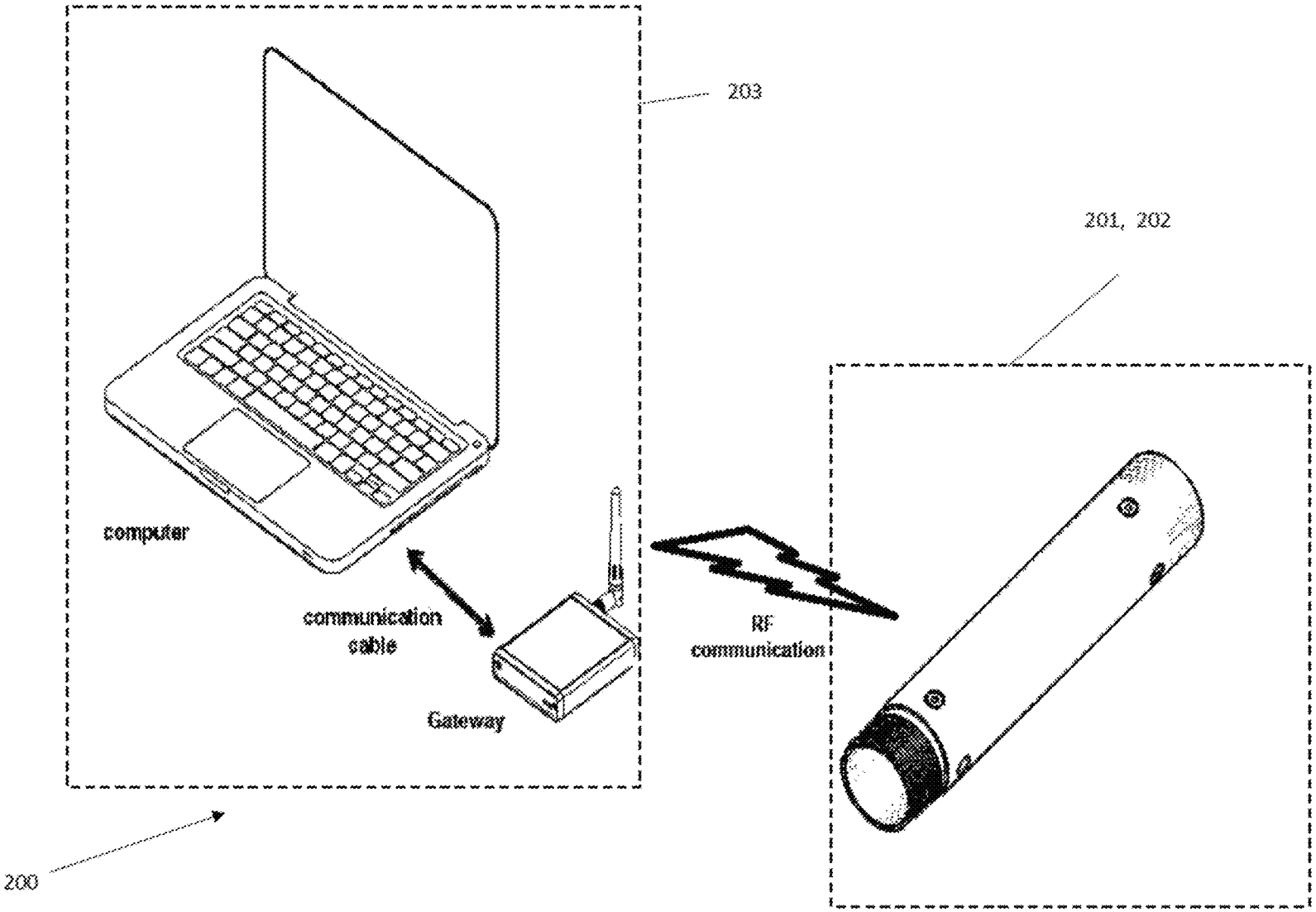
FIG. 15 shows the communication lines between the module and the user interface according to one embodiment of the present invention.

Recording Sensed Parameters and Communicating Recorded Data to an User Interface Referring to FIGS. 14 and 15, the apparatus includes an electrical/electronic configuration 200 for logging sensed data and communicating the logged data. The electrical/electronic configuration 200 has a sensing section 201, a processing and recording section 202, and an interface section 203.

The sensing section 201 includes sensors (strain sensing unit 20, temperature sensors and accelerometer) to sense conditions and capability to convert signals from the sensors into electrical signals.

The sensing section 201 is in wired communication with the processing and recording section 202. The sensing section 201 and the processing and recording section 202 are situated in the module 10.

The signals from the sensors are transmitted to the processing and recording section 202 where they are converted into readable parameters. The sensed parameters along with an associated time stamp are stored in a dedicated memory.

The processing and recording section 202 wirelessly communicates with the interface section 203 for example by RF communication or Bluetooth. Data stored in the data processing and recording section 202 is wirelessly transmitted to the interface section 203, where the sensed parameters are computed and provided to the user (drilling operator) on an interface such as a laptop computer.

The sensed parameters are presented to the drilling operator on an easy to understand graphic user interface (GUI). The drilling operator is able to interpret the data to understand what has been happening at the down the hole drilling.

Alternatively, the interface section 203 may have a program which interprets the sensed parameters and informs the drilling operator of any problem that occurred during drilling.

The interface section 203 is able to wirelessly operate the processing and recording section 202 for example to erase the recorded data in case the memory has insufficient capacity for the next round of drilling.

In use, the module 10 mounted on the drill string, at the bottom of the hole, records drilling parameters. After the module 10 is retrieved to the surface, the recorded data is transmitted to the interface section 203 for analysis.

Alternatively, wireless telemetry systems such as mud pulse telemetry or induction telemetry may be deployed to obtain drilling parameters in real time.

Alternative Embodiments

In an alternative embodiment, the outer pipe 12 is provided with a sealed RF transparent window to allow transmission/reception of wireless signals such that the module does not need to be disassembled from the drill string 110 to transmit recorded data to the computer.

In a further alternative embodiment, the second end cap 16 may have a two part construction. Particularly, a metal body which provides adequate strength and a polymer window fitted in the metal body which allows transmission/reception of RF signals from within the module 10. Such two part construction would provide strength as well as transmission capability of RF radiation.

In a further alternative embodiment, all sensors (such as accelerometer, thermocouple) are mounted within the module 10 but separate from the electronics sub-assembly 50. The electronics sub-assembly in this case is merely a data logger which received raw signals from the sensors via a single connector or multiple connectors.

In a further alternative embodiment, the strain gauge carrier 24 is evenly bonded to the outer pipe 12 by means of an annular and/or cylindrical elastomeric material which expands radially when compressed axially.

In a further alternative embodiment, the battery may be operated by means of a magnetically actuated reed switch or suchlike which is mounted adjacent to the second end cap 16. Such switch would enable switching the unit ON or OFF without the need to open the unit and break the seals of the aforementioned micro-switch 56.

In further alternative embodiment, there is provided a motion sensor for activating and deactivating the battery. If the motion sensor senses movement or rotation of the drill string, the battery is activated to power the electronics sub-assembly 50. If the motion sensor does not detect movement or rotation of the drill string for a pre-determined time interval, the battery is deactivated such that the electronics module is on 'sleep' mode. Such activation and deactivation helps conserve battery power. Such motion sensor may be in tandem with a switch or in stead of a switch, to operate the battery.

As various changes could be made in the above constructions and methods without departing from the scope of the invention, it is intended that all matter contained in the above description or shown in the accompanying drawing shall be interpreted as illustrative and not in a limiting sense.

REFERENCE NUMBER TABLE

| NO. | FEATURE |
|---|---|
| 10 | Module |
| 12 | Outer pipe |
| 14 | Inner pipe |
| 15 | First end cap |
| 16 | Second end cap |
| 17 | Fastener |
| 18 | Locating pin |
| 19 | Sealing member |
| 20 | Strain sensing unit |
| 22 | Support |
| 24 | Carrier |
| 25 | Strain sensor |
| 26 | Projection |
| 27 | Guide |
| 28 | Connector |
| 50 | Electronics sub-assembly |
| 51 | Housing |
| 52 | Battery |
| 54 | End-plate |
| 55 | Locating holes |
| 56 | Micro-switch |
| 58 | RF Antenna |
| 60 | Mother board |
| 62 | Extraction aid |
| 100 | Apparatus |
| 110 | Drill string |
| 120 | Drill bit |
| 130 | Cooling fluids |
| 200 | Electrical/Electronic configuration |
| 201 | Sensor section |
| 202 | Processing and recording section |
| 203 | Interface section |
| 70b | Load-cell sub-assembly |
| 72b | Recess for outer pipe mounting fastener |
| 74b | Carrier mounting fasteners |

Reference numerals associated with the module as per the second embodiment are suffixed with 'b' e.g. 10b, 15b, 60b, etc. The suffixed numerals refer to the same features of the corresponding numeral without the suffix listed above - but are used in conjunction with the arrangement of the second embodiment.

The claims defining the invention are as follows:

1. A drilling parameter measurement apparatus for measuring drilling parameters of a down-the-hole drilling operation for mineral exploration, the apparatus including a module mountable to form part of a drill string and configured to transfer compressive forces through the drill string to a drill bit for drilling, the module comprising:

a housing;

a strain measurement subassembly; and a removable annular electronics subassembly, wherein the housing comprises:

a cylindrical outer pipe having an outer diameter less than or equal to an outer diameter or a drill string pipe and configured, in use, to transfer compressive forces through the drill string to a drill bit for drilling;

an inner pipe having an inner diameter sized to allow sufficient flow of cooling drilling fluid through the module and an outer diameter to allow an annular space between an outer wall of the inner pipe and an inner wall of the outer pipe; and two end caps each having an annular disc shape to, in use, removably connect to a respective end of the inner pipe and the outer pipe in an annular arrangement and to sealingly enclose the annular space therebetween, with a passageway through the inner pipe for the cooling drilling fluid to flow through the module, wherein the strain measurement subassembly comprises:

an annular support;

at least one strain measurement sensor bonded to a carrier mounted on the annular support; and at least one connector on the annular support wired to the at least one strain measurement sensor, wherein the carrier is configured to support the strain measurement sensor proximate an inner wall of the cylindrical outer pipe during assembly, wherein during assembly strain measurement subassembly is threaded onto the inner pipe in the annular space and the carrier is subsequently bonded to an inner wall of the outer pipe and the strain measurement assembly fixed within the annular space, and wherein the removable annular electronics subassembly comprises:

an on-board processor and on-board memory;

at least one battery; and connectors to cooperate with connectors on the annular support to provide power and receive signals from the at least one strain measurement sensor for processing and storage in the on-board memory.

2. The apparatus of claim 1, wherein one or more of the strain measurement subassembly and removable annular electronics subassembly further comprise one or more sensors for sensing downhole conditions, wherein signals from the sensors are processed and stored in the on-board memory within the module.

3. The apparatus according to claim 2, wherein the one or more sensors include sensors for measuring temperature, vibration, rotation, and displacement.

4. The apparatus of claim 3, wherein the end caps seal the annular space such that the module acts as a pressure vessel for the removable annular electronics subassembly and strain measurement subassembly.

5. The apparatus of claim 4, wherein the outer pipe is a drill pipe sub.

6. The apparatus of claim 5, wherein at least one of the inner pipe and the outer pipe is replaceable.

7. The apparatus of claim 2, further comprising wireless communication transmitter configured to transmit logged data to a computer.

8. The apparatus of claim 1, wherein the carrier is a shim.

9. The apparatus of claim 1, wherein the strain measurement sensor includes a flexible metal carrier having strain gauges.

10. The apparatus of claim 1, wherein, in order to evenly bond the carrier to the inner wall of the module, a bladder is placed behind the carrier and inflated such that it presses the carrier against the inner wall of the outer pipe.

11. The apparatus of claim 1, wherein the strain measurement sensor is positioned such that it covers the removable annular electronics subassembly and is connected to the removable annular electronics subassembly via the connectors.

12. The apparatus of claim 11, wherein electronics componentry of the removable annular electronics subassembly is protected by potting a suitable resin at potential drilling muds ingress locations.

13. The apparatus of claim 1, wherein the at least one battery is connected by a switch which is turned on when the removable annular electronics subassembly is assembled in the module.

14. The apparatus of claim 1, wherein the at least one battery is operated when the drill string is detected to be moving and/or rotating.

15. The apparatus of claim 1, wherein the at least one battery is rechargeable.

16. The apparatus of claim 1, wherein at least one end cap is made of material enabling wireless signals to be transmitted/received from within the module.

17. A method of measuring drilling parameters of a down-the-hole drilling operation for mineral exploration, the method comprising:

providing a first drilling parameter measurement apparatus as claimed in claim 2 in a drill string of the drilling operation, and during operation of the drill string, sensing conditions by use of at least one strain measurement sensor to measure strain within the drill string from the inner wall of the outer pipe of the module.

18. The method of claim 17, further comprising:

during operation of the drill string:

measuring drilling parameters based on the conditions sensed by at least one or more sensors, wherein the measured parameters assist in determining at least one of weight on drill bit, thrust or hold-back force exerted on the drill string, force due to strain in the drill string, torque and RPM fluctuations proximate the drill bit, axial and radial vibrations proximate the drill bit, temperature proximate the drill bit, and drilling penetration rate.

19. The method of claim 18, further comprising:

providing a second drilling parameter measurement apparatus as claimed in claim 2 in a drill string of the drilling operation distal to the first drilling parameter apparatus;

measuring drilling parameters based on the conditions sensed by the at least one or more sensors of the second drilling parameter apparatus; and computing differences in the drilling parameters measured by the two modules to obtain comparative data.

20. The method of claim 19, wherein the second drilling parameter measurement apparatus is mounted in the drill string distal to the drill bit and the first drilling parameter apparatus is mounted in the drill string proximate the drill bit relative to the second drilling parameter measurement apparatus.

21. A method as claimed in claim 20, wherein the comparative data is used in determining at least one of vertical resistance of the drill string, rotational resistance of the drill string, degree of wind-up of the drill string, and presence of slip conditions at lower end of the drill string.

22. A drilling parameter measurement apparatus for measuring drilling parameters of a down-the-hole drilling operation for mineral exploration, the apparatus including a module mountable to form part of a drill string and configured to transfer compressive forces through the drill string to a drill bit for drilling, the module comprising:

a carrier and at least one strain measurement sensor bonded to the carrier;

an annular electronics subassembly comprising:

an on-board processor and on-board memory;

at least one battery; and a wired connection to the strain measurement sensors to provide power and receive signals from the at least one strain measurement sensor for processing and storage in the on-board memory;

a cylindrical outer pipe having an outer diameter less than or equal to an outer diameter or a drill string pipe and configured, in use, to transfer compressive forces through the drill string to a drill bit for drilling;

an inner pipe having an inner diameter sized to allow sufficient flow of cooling drilling fluid through the module and an outer diameter to allow an annular space between an outer wall of the inner pipe and an inner wall of the outer pipe;

two end caps each having an annular disc shape to, in use, removably connect to a respective end of the inner pipe and the outer pipe in an annular arrangement and to sealingly enclose the annular space therebetween, with a passageway through the inner pipe for the cooling drilling fluid to flow through the module, wherein:

the annular electronics subassembly is configured to be threaded over the inner pipe and mounted between the two end caps;

the carrier is configured to be attached to each respective end cap to form a load cell; and the outer pipe is passed over the load cell and connected to the end caps, and wherein the strain from the outer pipe is transmitted to the carrier via the end caps for measurement by the strain measurement sensors.

* * * * *